US012274348B1

(12) United States Patent
Washington

(10) Patent No.: US 12,274,348 B1
(45) Date of Patent: Apr. 15, 2025

(54) FOOT LOTION APPLICATION DEVICE

(71) Applicant: Frank Washington, Detroit, MI (US)

(72) Inventor: Frank Washington, Detroit, MI (US)

( * ) Notice: Subject to any disclaimer, the term of this patent is extended or adjusted under 35 U.S.C. 154(b) by 0 days.

(21) Appl. No.: 18/616,864

(22) Filed: Mar. 26, 2024

Related U.S. Application Data

(60) Provisional application No. 63/606,676, filed on Dec. 6, 2023.

(51) Int. Cl.
*A45D 34/04* (2006.01)
*A45D 40/26* (2006.01)
*A47K 3/022* (2006.01)

(52) U.S. Cl.
CPC ..... *A45D 34/042* (2013.01); *A45D 40/262* (2013.01); *A45D 2200/1054* (2013.01); *A47K 3/022* (2013.01)

(58) Field of Classification Search
CPC .. A45D 34/042; A45D 34/043; A45D 40/262; A45D 40/264; A45D 2200/05; A45D 2200/1054; A47K 3/022; A47K 3/02; A47K 3/06; A47K 3/062
USPC ..... 401/6, 123, 118, 137; 4/622; 220/761
See application file for complete search history.

(56) References Cited

U.S. PATENT DOCUMENTS

| | | | | |
|---|---|---|---|---|
| 3,030,967 | A | 4/1962 | Peyron | |
| 6,129,469 | A | 10/2000 | Messer | |
| 6,405,390 | B2 * | 6/2002 | Kuen | A47K 3/022 601/158 |
| 6,530,707 | B1 | 3/2003 | Byrne | |
| 7,165,285 | B1 | 1/2007 | Hajianpour | |
| 7,426,757 | B2 * | 9/2008 | Lev | A61H 35/006 220/761 |
| 2003/0097724 | A1 | 5/2003 | Park | |
| 2003/0208864 | A1 | 11/2003 | Kohler | |

* cited by examiner

*Primary Examiner* — David J Walczak
(74) *Attorney, Agent, or Firm* — Brennan, Manna & Diamond, LLC

(57) ABSTRACT

A lotion application device is used for applying creams or lotions on difficult-to-reach places on the body, like the feet. The lotion application device comprises a base component that is configured with an open cavity for a user to insert at least one foot. Within the open cavity of the base component, an electrically powered brush with two spinning brush heads is positioned. The electrically powered brush is operated via a remote control. Further, lotion or ointment is stored within the base component and dispensed onto a user's feet and ankles, as needed. Once a person places their foot into the open cavity of the base component, he/she can activate the device with the remote control and utilize the gentle scrubbing brush heads to evenly distribute lotion to treat dry and cracked skin on the feet.

20 Claims, 3 Drawing Sheets

FOOT LOTION APPLICATION DEVICE

CROSS-REFERENCE TO RELATED APPLICATION

The present application claims priority to, and the benefit of, U.S. Provisional Application No. 63/606,676, which was filed on Dec. 6, 2023, and is incorporated herein by reference in its entirety.

FIELD OF THE INVENTION

The present invention relates generally to the field of lotion application devices. More specifically, the present invention relates to a tool designed to apply creams, lotions, ointments, and other products to the bottom of feet. Accordingly, the present disclosure makes specific reference thereto. Nonetheless, it is to be appreciated that aspects of the present invention are also equally applicable to other like applications, devices, and methods of manufacture.

BACKGROUND

By way of background, this invention relates to improvements in lotion application devices. Generally, people may experience dry skin and sores on their feet that require lotion, ointment, and other treatments. Further, some individuals may lack mobility and be unable to easily apply lotions and ointments to their feet. Accordingly, untreated dry skin can start to crack and bleed, ultimately leading to severe injury and medical issues.

Furthermore, it is well known and appreciated that it is difficult to apply a liquid, such as lotion, sunscreen, or moisturizer to one's own feet. Typically, a person must bend down to apply lotion to their feet or bring their foot up towards their hands, neither is a particularly easy position in which to apply lotion, sunscreen, ointment, etc. Additionally, users with limited mobility have even more difficulties in applying lotion to their feet. Consequently, an easier application process is necessary for applying lotion, ointment, sunscreen, etc., to one's feet.

Accordingly, there is a demand for an improved lotion application device that enables users to remain in a comfortable position when applying products to their feet. More particularly, there is a demand for a lotion application device that enables a user to apply lotion quickly and efficiently and without bending over.

Therefore, there exists a long-felt need in the art for a lotion application device that provides users with a tool designed to apply creams, lotions, ointments, and other products to the bottom of feet. There is also a long-felt need in the art for a lotion application device that features rotation mechanisms that support soft bristle brushes to evenly apply lotions and ointments to the feet. Further, there is a long-felt need in the art for a lotion application device that allows users to control the rotation and speed of the brushes via a remote control. Moreover, there is a long-felt need in the art for a device that enables users to remain in a comfortable standing or seated position to apply products to the feet without having to bend over. Further, there is a long-felt need in the art for a lotion application device that saves considerable time and effort when treating dry skin on the feet. Finally, there is a long-felt need in the art for a lotion application device that stores lotion or ointment within the device.

The subject matter disclosed and claimed herein, in one embodiment thereof, comprises a lotion application device.

The device is used for applying creams or lotions on difficult-to-reach places on the body, like the feet. Specifically, the device helps a user apply lotion or ointment to his or her feet and ankles. The lotion application device comprises a base component that is configured with an open cavity for a user to insert at least one foot. Within the open cavity of the base component, an electrically powered brush with two spinning brush heads is positioned. The electrically powered brush is operated via a remote control. Further, lotion or ointment is stored within the base component and dispensed onto a user's feet and ankles, as needed. Once a person places their foot into the open cavity of the base component, he/she can activate the device with the remote control and utilize the gentle scrubbing brush heads to evenly distribute lotion to treat dry and cracked skin on the feet.

In this manner, the lotion application device of the present invention accomplishes all of the foregoing objectives and provides users with a device that enables the easy and efficient application of lotion on a user's feet. The device prevents users from bending down to apply lotion. The device can be manufactured of a plastic material.

SUMMARY OF THE INVENTION

The following presents a simplified summary in order to provide a basic understanding of some aspects of the disclosed innovation. This summary is not an extensive overview, and it is not intended to identify key/critical elements or to delineate the scope thereof. Its sole purpose is to present some general concepts in a simplified form as a prelude to the more detailed description that is presented later.

The subject matter disclosed and claimed herein, in one embodiment thereof, comprises a lotion application device. The device is used for applying creams or lotions on difficult-to-reach places on the body, like the feet. The lotion application device comprises a base component that is configured with an open cavity for a user to insert at least one foot. Within the open cavity of the base component, an electrically powered brush with two spinning brush heads is positioned. The electrically powered brush is operated via a remote control. Further, lotion or ointment is stored within the base component and dispensed onto a user's feet and ankles, as needed. Once a person places their foot into the open cavity of the base component, he/she can activate the device with the remote control and utilize the gentle scrubbing brush heads to evenly distribute lotion to treat dry and cracked skin on the feet.

In one embodiment, the lotion application device is utilized for applying a lotion or ointment, such as a moisturizing lotion, a sunscreen lotion, a medicinal ointment, etc., to a remote area of a person's body, such as the feet. The lotion application device comprises a base component that comprises any suitable shape and size as is known in the art, as long as the base component is shaped and sized to retain at least one foot. The base component comprises a bottom surface, opposing right and left sidewalls and opposing front and back sidewalls, and an open cavity for insertion of the at least one foot. The sidewalls extend up from the bottom surface to create an enclosure which retains the user's foot, as well as rotating brushes and lotion.

In one embodiment, the base component can be sized and shaped to retain two feet at once.

In one embodiment, the base component comprises a lid component which seals the open cavity when the device is not in use. The lid component can comprise hinges and a latch to secure the lid component to the base component. The lid component can also comprise a handle to allow for easy transport of the device, as needed.

In one embodiment, the bottom of the base component comprises four supports or legs for supporting the device on the floor. The supports or legs can be secured via any suitable securing means as is known in the art.

In one embodiment, the bottom surface of the base component comprises an electrically powered brush. The brush typically comprises at least two spinning brush heads. However, any suitable number of brush heads can be utilized as is known in the art. The brush heads and brush are typically arranged to match the user's foot sole. Multiple spinning brush heads can be provided with the device and the user can determine which brush heads to attach and use, as needed. Further, when the brush heads wear down, a user can remove and replace the brush heads, as needed.

In one embodiment, the brush heads are circular pads with a Velcro backing or other suitable securing means as is known in the art, for securing to the powered brush. The brush heads can be any suitable shape and size as is known in the art, depending on the wants and/or needs of a user. Generally, the spinning brush heads have a spongey surface, a textured surface, or a soft, absorbent surface. Specifically, the brush heads may be composed of a porous material that can absorb and release a lotion, such as an open-cell elastomeric foam resin or a natural or synthetic sponge material. In another embodiment, the brush head can comprise a plurality of soft bristles to evenly apply lotions and ointments to the feet.

In one embodiment, the brush head comprises an outer layer composed of a solid elastomeric resin and a core composed of an elastomeric foam resin. Alternatively, the brush head may be composed of a silicone rubber. Preferably, the outer layer of the brush head has an external surface with a texture providing pockets to hold lotion, providing ridges or bumps allowing lotion to be held on intervening surfaces, or including a number of grooves holding lotion during the process of its application, and/or a number of bumps allowing lotion to be held on the intervening portions of the surface of the brush heads.

In one embodiment, the base component comprises a dispenser component for retaining and dispensing lotion and ointment, as needed. Typically, the dispenser component is positioned on an interior side of the base component within the open cavity, but can be positioned in any suitable place, as long as the dispenser component can dispense lotion, ointment, or some other viscous liquid on the user's feet and/or the brush heads. Once the lotion is dispensed on the user's feet, ankles, and/or brush heads, the electrically powered brush spins and rotates, spreading lotion on a user's feet in a smooth, controlled, and complete manner.

In one embodiment, the electrically powered brush is associated with and in communication with a motor, which is used to drive a drive shaft in rotation and spinning of the brush heads. Specifically, the drive shaft provides for rotation of the brush heads about an axis of rotation, with the flat application surface of the brush heads extending perpendicularly from this axis of rotation. Typically, the motor is held within the base component of the device and also provides for the dispensing of lotion from the dispenser component. Generally, the motor is connected to and in communication with a controller, for controlling the motor. At least one battery is then connected to the controller, which provides a power source for the motor. The controller uses the power produced from the batteries to power the motor, which controls the rotation and spinning of the brush heads. Thus, the motor is electrically driven through communication with a plurality of batteries. The plurality of batteries provide electrical current which flows through the batteries and the motor so that the drive shaft is turned, rotating and spinning the brush heads. The batteries can be removed for replacement, as needed. New batteries can then be inserted in the battery compartment.

In one embodiment, the exterior of the base component comprises an actuator button for manually powering on and off the motor, which causes rotation of the brush heads.

In one embodiment, the base component comprises an LCD screen, which is in communication with the batteries and controller and alerts a user as to the battery life of the batteries. The LCD monitor also comprises the actuator button for manually turning off and on the device.

In one embodiment, the motor and the rotation and speed of the brush heads are controlled by a remote control. Users can also control the amount and frequency of lotion dispensing via the dispenser component by the remote control. Once a user places a foot into the base component, the user can activate the brush heads and the dispensing of lotion via the remote control.

In another embodiment, the controller is configured to wirelessly communicate with a mobile application. For purposes of this document, a connection may be a direct connection or an indirect connection (i.e., via intervening elements). Two devices are "in communication" if they are directly or indirectly connected so that they can communicate electronic signals between them. Specifically, the base component comprises a wireless control unit or module, which is connected to and controls the motor to rotate the brush heads. The wireless control unit or module can also be wirelessly connected to a smartphone and an application on the smartphone using Bluetooth.

In one embodiment, the base component can be easily cleaned and sanitized, as needed. Further, the base component can comprise a sanitizing function that, when activated, cleans and sanitizes the interior of the base component.

In yet another embodiment, the lotion application device comprises a plurality of indicia.

In yet another embodiment, a method of applying lotion to a user's feet is disclosed. The method includes the steps of providing a lotion application device comprising a base component with an open cavity and an electrically powered brush. The method also comprises inserting at least one foot into the open cavity. Further, the method comprises dispensing lotion or ointment as needed onto the foot within the open cavity. Finally, the method comprises operating the electrically powered brush via a remote control to rotate and evenly distribute lotion or ointment on the user's foot.

Numerous benefits and advantages of this invention will become apparent to those skilled in the art to which it pertains, upon reading and understanding the following detailed specification.

To the accomplishment of the foregoing and related ends, certain illustrative aspects of the disclosed innovation are described herein in connection with the following description and the annexed drawings. These aspects are indicative, however, of but a few of the various ways in which the principles disclosed herein can be employed and are intended to include all such aspects and their equivalents. Other advantages and novel features will become apparent from the following detailed description when considered in conjunction with the drawings.

BRIEF DESCRIPTION OF THE DRAWINGS

The description refers to provided drawings in which similar reference characters refer to similar parts throughout the different views, and in which.

DETAILED DESCRIPTION OF THE PRESENT INVENTION

Figure 1:
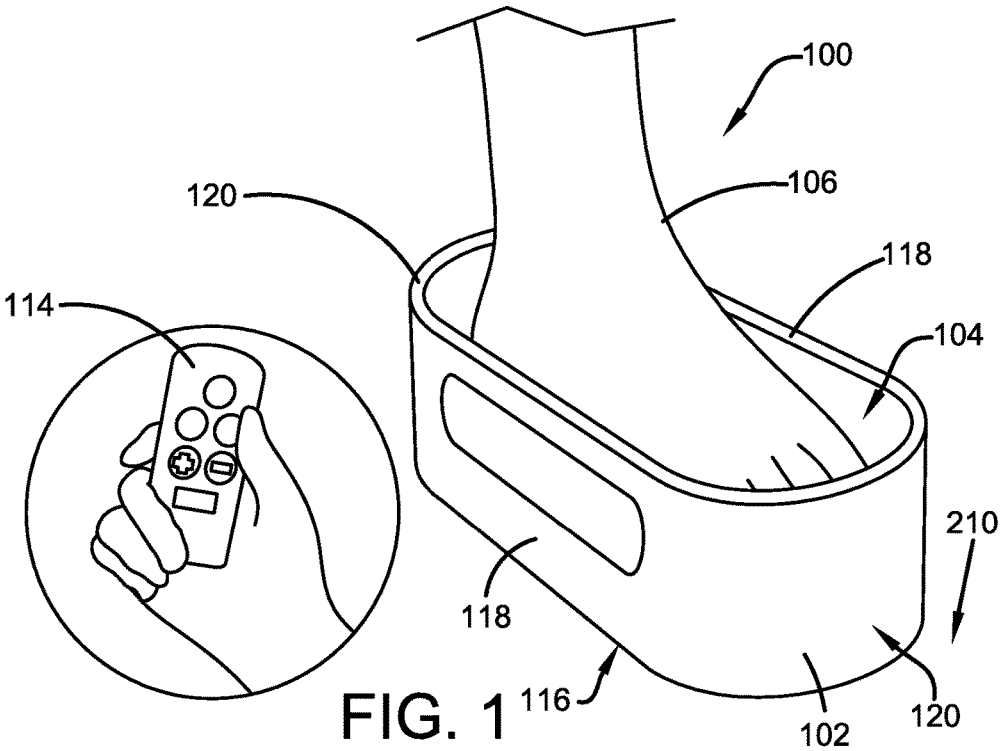
FIG. 1 illustrates a perspective view of one embodiment of the lotion application device of the present invention showing the device operated by a remote control in accordance with the disclosed architecture.

The innovation is now described with reference to the drawings, wherein like reference numerals are used to refer to like elements throughout. In the following description, for purposes of explanation, numerous specific details are set forth in order to provide a thorough understanding thereof. It may be evident, however, that the innovation can be practiced without these specific details. In other instances, well-known structures and devices are shown in block diagram form in order to facilitate a description thereof. Various embodiments are discussed hereinafter. It should be noted that the figures are described only to facilitate the description of the embodiments. They are not intended as an exhaustive description of the invention and do not limit the scope of the invention. Additionally, an illustrated embodiment need not have all the aspects or advantages shown. Thus, in other embodiments, any of the features described herein from different embodiments may be combined.

As noted above, there is a long-felt need in the art for a lotion application device that provides users with a tool designed to apply creams, lotions, ointments, and other products to the bottom of feet. There is also a long-felt need in the art for a lotion application device that features rotation mechanisms that support soft bristle brushes to evenly apply lotions and ointments to the feet. Further, there is a long-felt need in the art for a lotion application device that allows users to control the rotation and speed of the brushes via a remote control. Moreover, there is a long-felt need in the art for a device that enables users to remain in a comfortable standing or seated position to apply products to the feet without having to bend over. Further, there is a long-felt need in the art for a lotion application device that saves considerable time and effort when treating dry skin on the feet. Finally, there is a long-felt need in the art for a lotion application device that stores lotion or ointment within the device.

The present invention, in one exemplary embodiment, is a novel lotion application device. The device is used for applying creams or lotions on difficult-to-reach places on the body, like the feet. The lotion application device comprises a base component that is configured with an open cavity for a user to insert at least one foot. Within the open cavity of the base component, an electrically powered brush with two spinning brush heads is positioned. The electrically powered brush is operated via a remote control. Further, lotion or ointment is stored within the base component and dispensed onto a user's feet and ankles, as needed. Once a person places their foot into the open cavity of the base component, he/she can activate the device with the remote control and utilize the gentle scrubbing brush heads to evenly distribute lotion to treat dry and cracked skin on the feet. The present invention also includes a novel method of applying lotion to a user's feet. The method includes the steps of providing a lotion application device comprising a base component with an open cavity and an electrically powered brush. The method also comprises inserting at least one foot into the open cavity. Further, the method comprises dispensing lotion or ointment as needed onto the foot within the open cavity. Finally, the method comprises operating the electrically powered brush via a remote control to rotate and evenly distribute lotion or ointment on the user's foot.

Referring initially to the drawings, FIG. 1 illustrates a perspective view of one embodiment of the lotion application device 100 of the present invention. In the present embodiment, the lotion application device 100 is an improved lotion application device 100 that provides a device for applying creams or lotions 108 on difficult-to-reach places on the body, such as the feet 106. Specifically, the lotion application device 100 comprises a base component 102 that is configured with an open cavity 104 for a user to insert at least one foot 106. Within the open cavity 104 of the base component 102, an electrically powered brush 110 with two spinning brush heads 112 is positioned. The electrically powered brush 110 is operated via a remote control 114. Further, lotion 108 or ointment is stored within the base component 102 and dispensed onto a user's feet 106 and ankles, as needed. Once a person places their foot 106 into the open cavity 104 of the base component 102, he/she can activate the device 100 with the remote control 114 and utilize the gentle scrubbing brush heads 112 to evenly distribute lotion 108 to treat dry and cracked skin on the feet 106.

Generally, the lotion application device 100 is utilized for applying a lotion 108 or ointment, such as a moisturizing lotion, a sunscreen lotion, a medicinal ointment, etc., to a remote area of a person's body, such as the feet 106. The lotion application device 100 comprises a base component 102 that comprises any suitable shape and size as is known in the art, as long as the base component 102 is shaped and sized to retain at least one foot 106. The base component 102 comprises a bottom surface 116, opposing right and left sidewalls 118 and opposing front and back sidewalls 120, and an open cavity 104 for insertion of at least one foot 106. The sidewalls 118, 120 extend up from the bottom surface 116 to create an enclosure which retains the user's foot 106, as well as rotating brush heads 112 and lotion 108.

Figure 2:
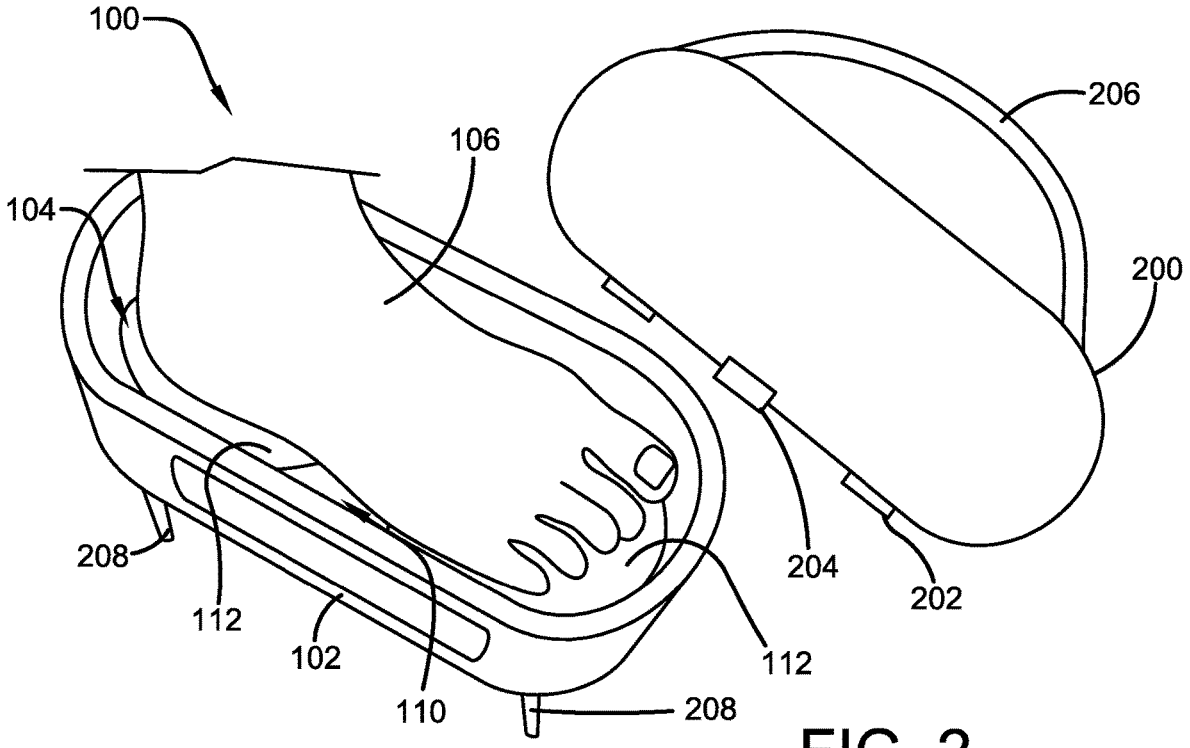
FIG. 2 illustrates a perspective view of one embodiment of the lotion application device of the present invention showing a user's foot positioned within the open cavity in accordance with the disclosed architecture.
Figure 3A:
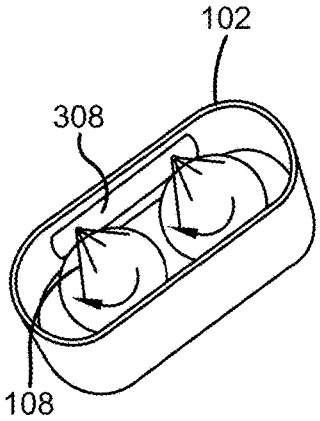
FIGS. 3A-C illustrate a perspective view of one embodiment of the lotion application device of the present invention showing how the brush heads rotate and how lotion is dispensed in accordance with the disclosed architecture.
Figure 3B:
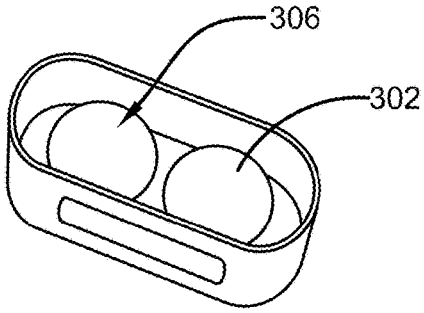
Figure 3C:
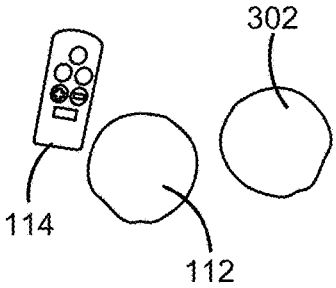
Figure 4B:
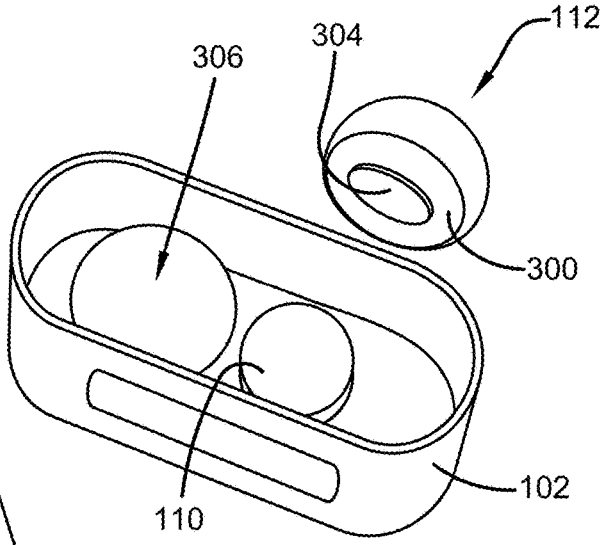
FIGS. 4A-B illustrate a perspective view of one embodiment of the lotion application device of the present invention showing the mechanical rotation mechanism and how the brush heads are applied in accordance with the disclosed architecture.
Figure 4A:
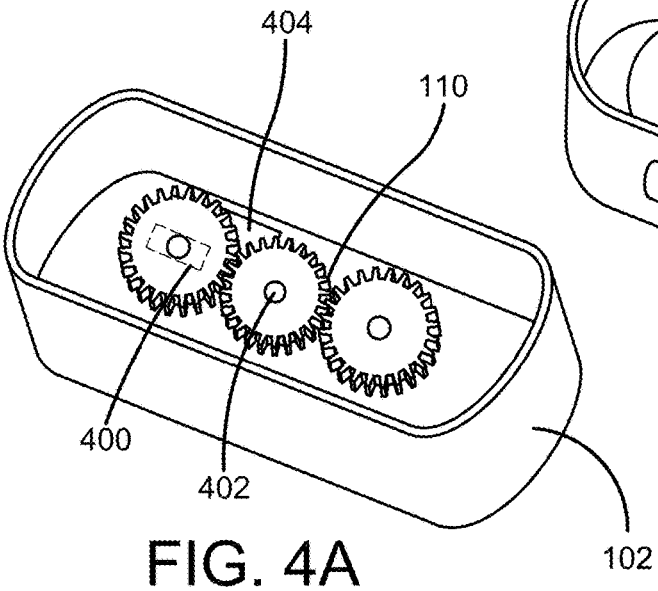

As shown in FIG. 2, in one embodiment, the base component 102 can be sized and shaped to retain two feet 106 at once. However, any suitable size base component 102 can be utilized as is known in the art, as long as the base component 102 retains at least one foot 106.

Further, in another embodiment, the base component 102 comprises a lid component 200 which seals the open cavity 104 when the device 100 is not in use. Additionally, the lid component 200 can comprise hinges 202 which secure the lid component 200 to an end of the open cavity 104 and allow the lid component 200 to open and close, but still remain attached to the base component 102. The lid component 200 can also include a latch 204 or other securing means, which locks the lid component 200 in place on the base component 102. The lid component 200 can also comprise a handle 206 to allow for easy transport of the device 100, as needed. The handle 206 can be secured to the right and left side walls 120 of the base component or to the lid component 200 via any suitable securing means as is known in the art, depending on the needs and/or wants of a user.

In yet another embodiment, the bottom 116 of the base component 102 comprises four supports or legs 208 for supporting the device 100 on the floor 210. The supports or legs 208 can be secured via any suitable securing means as is known in the art. Further, any suitable number of legs 208 can be secured to the base component 102 as is deemed necessary to support and stabilize the device 100, while positioned on the floor 210 for use. The legs 208 would also help support the device 100 if a user chooses to stand within the open cavity 104 to use the device 100.

As shown in FIGS. 3A-C and 4A-B, the bottom surface 116 of the base component 102 comprises an electrically powered brush 110. The brush 110 typically comprises at least two spinning brush heads 112. However, any suitable number of brush heads 112 can be utilized as is known in the art. The brush heads 112 and brush 110 are typically arranged to match the user's foot sole. Multiple spinning brush heads 112 can be provided with the device 100 and the user can determine which brush heads 112 to attach and use, as needed. Further, when the brush heads 112 wear down, a user can remove and replace the brush heads 112, as needed.

Generally, the brush heads 112 are circular pads with a Velcro 300 backing or other suitable securing means as is known in the art, for securing to the powered brush 110. The brush heads 112 can be any suitable shape and size as is known in the art, depending on the wants and/or needs of a user. Generally, the spinning brush heads 112 have a spongey surface, a textured surface, or a soft, absorbent surface. Specifically, the brush heads 112 may be composed of a porous material that can absorb and release a lotion 108, such as an open-cell elastomeric foam resin or a natural or synthetic sponge material. In another embodiment, the brush head 112 can comprise a plurality of soft bristles to evenly apply lotions and ointments to the feet 106.

In one embodiment, the brush head 112 comprises an outer layer 302 composed of a solid elastomeric resin and a core 304 composed of an elastomeric foam resin. Alternatively, the brush head 112 may be composed of a silicone rubber. Preferably, the outer layer 302 of the brush head 112 has an external surface with a texture 306 providing pockets to hold lotion 108, or providing ridges or bumps allowing lotion 108 to be held on intervening surfaces, or including a number of grooves holding lotion 108 during the process of its application, and/or a number of bumps allowing lotion 108 to be held on the intervening portions of the surface 302 of the brush heads 112.

Further, the base component 102 comprises a dispenser component 308 for retaining and dispensing lotion 108 and ointment, as needed. Typically, the dispenser component 308 is positioned on an interior side of the base component 102 within the open cavity 104, but can be positioned in any suitable place, as long as the dispenser component 308 can dispense lotion 108, ointment, or some other viscous liquid on the user's feet 106 and/or the brush heads 112. Once the lotion 108 is dispensed on the user's feet 106, ankles, and/or brush heads 112, the electrically powered brush 110 spins and rotates, spreading lotion 108 on a user's feet 106 in a smooth, controlled, and complete manner.

Additionally, the electrically powered brush 110 is associated with and in communication with a motor 400, which is used to drive a drive shaft 402 in rotation and spinning of the brush heads 112. Specifically, the drive shaft 402 provides for rotation of the brush heads 112 about an axis of rotation, with the flat application surface 302 of the brush heads 112 extending perpendicularly from this axis of rotation. Typically, the motor 400 is held within the base component 102 of the device 100 and also provides for the dispensing of lotion 108 from the dispenser component 308. Generally, the motor 400 is connected to and in communication with a controller 404, for controlling the motor 400. At least one battery 406 is then connected to the controller 404, which provides a power source for the motor 400. The controller 404 uses the power produced from the batteries 406 to power the motor 400, which controls the rotation and spinning of the brush heads 112. Thus, the motor 400 is electrically driven through communication with a plurality of batteries 406. The plurality of batteries 406 provide electrical current which flows through the batteries 406 and the motor 400 so that the drive shaft 402 is turned, rotating and spinning the brush heads 112. The batteries 406 can be removed for replacement, as needed. New batteries 406 can then be inserted in the battery compartment 408.

The battery 406 may be a disposable battery or a rechargeable battery in the form of an alkaline, nickel-cadmium, nickel-metal hydride battery, etc., such as any 3V-12 volts DC battery or other conventional battery, such as A, AA, AAA, etc., that supplies power to the lotion application device 100. Throughout this specification, the term "battery" may be used interchangeably to refer to one or more wet or dry cells or batteries of cells in which chemical energy is converted into electricity and used as a source of DC power. References to recharging or replacing the battery 406 may refer to recharging or replacing individual cells, individual batteries of cells, or a package of multiple battery cells as is appropriate for any given battery technology that may be used. In addition, a rechargeable embodiment of the battery 406 may be recharged using a USB port (not shown), wherein the USB port is a USB-A, USB-B, Micro-B, Micro-USB, Mini-USB, or USB-C port, etc.

Furthermore, the motor 400 and the rotation and speed of the brush heads 112 are controlled by a remote control 114. Users can also control the amount and frequency of lotion dispensing via the dispenser component 308 by the remote control 114. Once a user places a foot 106 into the base component 102, the user can activate the brush heads 112 and the dispensing of lotion 108 via the remote control 114. Thus, the remote control 114 is in communication with the motor 400 and controller 404 of the device 100.

Figure 5:
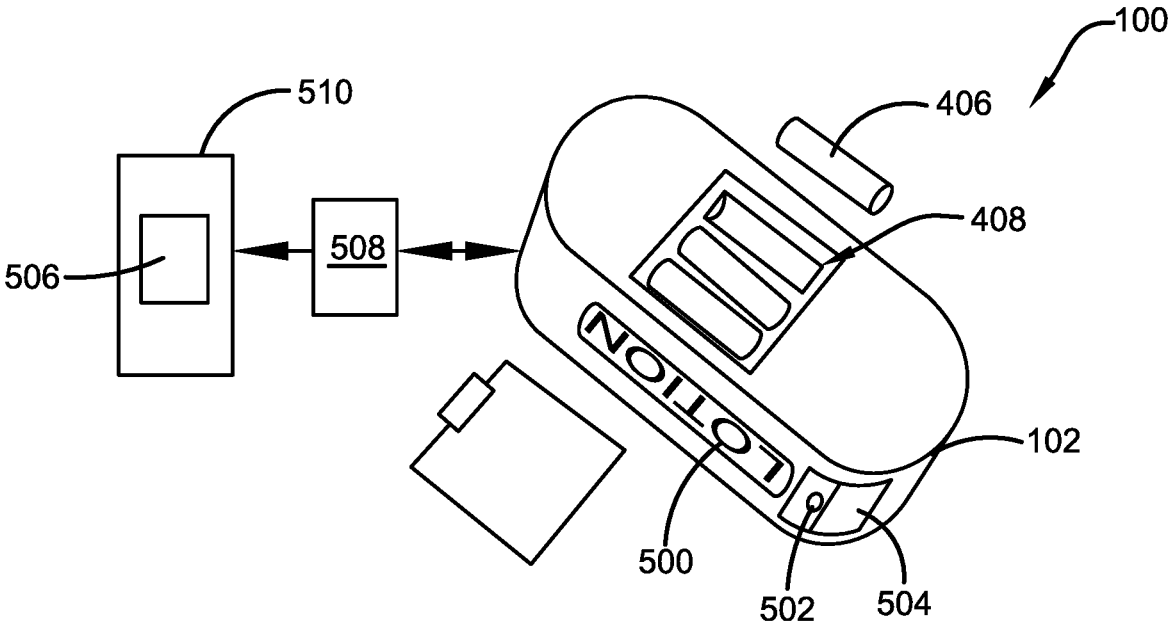
FIG. 5 illustrates a perspective view of one embodiment of the lotion application device of the present invention showing the battery compartment in accordance with the disclosed architecture.

As shown in FIG. 5, the exterior of the base component 102 comprises an actuator button 502 for manually powering on and off the motor 400, which causes rotation of the brush heads 112. Further, in one embodiment, the base component 102 comprises an LCD screen 504, which is in communication with the batteries 406 and controller 404 and alerts a user as to the battery life of the batteries 406. The LCD monitor 504 also comprises the actuator button 502 for manually turning off and on the device 100.

In another embodiment, the controller 404 is configured to wirelessly communicate with a mobile application 506. For purposes of this document, a connection may be a direct connection or an indirect connection (i.e., via intervening elements). Two devices are "in communication" if they are directly or indirectly connected so that they can communicate electronic signals between them. Specifically, the base component 102 comprises a wireless control unit or module 508, which is connected to and controls the motor 400 to rotate the brush heads 112. The wireless control unit or module 508 can also be wirelessly connected to a smartphone 510 and an application 506 on the smartphone 510 using Bluetooth.

In one embodiment, the base component 102 can be easily cleaned and sanitized, as needed. Further, the base component 102 can comprise a sanitizing function that, when activated, cleans and sanitizes the interior of the base component 102.

In yet another embodiment, the lotion application device 100 comprises a plurality of indicia 500. The base component 102 of the device 100 may include advertising, a trademark, or other letters, designs, or characters, printed, painted, stamped, or integrated into the base component 102, or any other indicia 500 as is known in the art. Specifically, any suitable indicia 500 as is known in the art can be included, such as, but not limited to, patterns, logos, emblems, images, symbols, designs, letters, words, characters, animals, advertisements, brands, etc., that may or may not be lotion, feet, or brand related.

Figure 6:
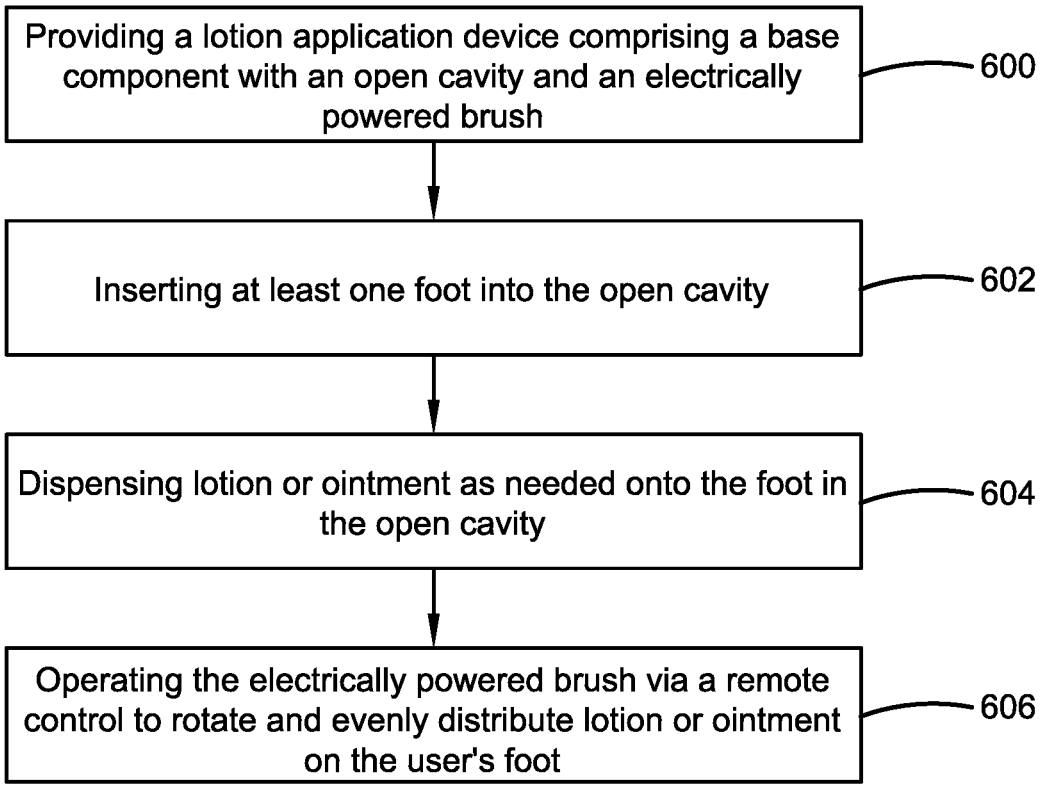
FIG. 6 illustrates a flowchart showing the method of applying lotion to a user's feet in accordance with the disclosed architecture.

FIG. 6 illustrates a flowchart of the method of applying lotion to a user's feet. The method includes the steps of at 600, providing a lotion application device comprising a base component with an open cavity and an electrically powered brush. The method also comprises at 602, inserting at least one foot into the open cavity. Further, the method comprises at 604, dispensing lotion or ointment as needed onto the foot within the open cavity. Finally, the method comprises at 606, operating the electrically powered brush via a remote control to rotate and evenly distribute lotion or ointment on the user's foot.

Certain terms are used throughout the following description and claims to refer to particular features or components. As one skilled in the art will appreciate, different users may refer to the same feature or component by different names. This document does not intend to distinguish between components or features that differ in name but not structure or function. As used herein "lotion application device", "lotion device", and "device" are interchangeable and refer to the lotion application device 100 of the present invention.

Notwithstanding the foregoing, the lotion application device 100 of the present invention can be of any suitable size and configuration as is known in the art without affecting the overall concept of the invention, provided that it accomplishes the above-stated objectives. One of ordinary skill in the art will appreciate that the lotion application device 100 as shown in FIGS. 1-6 is for illustrative purposes only, and that many other sizes and shapes of the lotion application device 100 are well within the scope of the present disclosure. Although the dimensions of the lotion application device 100 are important design parameters for user convenience, the lotion application device 100 may be of any size that ensures optimal performance during use and/or that suits the user's needs and/or preferences.

Various modifications and additions can be made to the exemplary embodiments discussed without departing from the scope of the present invention. While the embodiments described above refer to particular features, the scope of this invention also includes embodiments having different combinations of features and embodiments that do not include all of the described features. Accordingly, the scope of the present invention is intended to embrace all such alternatives, modifications, and variations as fall within the scope of the claims, together with all equivalents thereof.

What has been described above includes examples of the claimed subject matter. It is, of course, not possible to describe every conceivable combination of components or methodologies for purposes of describing the claimed subject matter, but one of ordinary skill in the art may recognize that many further combinations and permutations of the claimed subject matter are possible. Accordingly, the claimed subject matter is intended to embrace all such alterations, modifications, and variations that fall within the spirit and scope of the appended claims. Furthermore, to the extent that the term "includes" is used in either the detailed description or the claims, such term is intended to be inclusive in a manner similar to the term "comprising" as "comprising" is interpreted when employed as a transitional word in a claim.

What is claimed is:

1. A lotion application device for applying creams or lotions on a user's feet, the lotion application device comprising:

a base component;

wherein the base component is configured with an open cavity for a user to insert at least one foot;

wherein an interior of the base component comprises a dispenser component for retaining lotion;

wherein the base component comprises an electrically powered brush and two spinning brush heads for evenly distributing lotion to treat dry and cracked skin on the feet; and wherein a motor positioned within the base component is configured to engage the dispenser component to dispense the lotion into the open cavity.

2. The lotion application device of claim 1, wherein the base component comprises a bottom surface, opposing right and left sidewalls and opposing front and back sidewalls, and an open cavity for insertion of the at least one foot.

3. The lotion application device of claim 2, wherein the opposing right and left sidewalls and the opposing front and back sidewalls extend up from the bottom surface to create an enclosure which retains at least one foot, as well as the two spinning brush heads and lotion.

4. The lotion application device of claim 3, wherein the base component is sized and shaped to retain two feet at once.

5. The lotion application device of claim 3, wherein the base component comprises a lid component which seals the open cavity when the lotion application device is not in use.

6. The lotion application device of claim 5, wherein the lid component comprises hinges and a latch to secure the lid component in place.

7. The lotion application device of claim 6, wherein the lid component comprises a handle for transport.

8. The lotion application device of claim 7, wherein a bottom of the base component comprises four legs for supporting the lotion application device on a floor.

9. The lotion application device of claim 8, wherein the two spinning brush heads are circular pads which are secured to the electrically powered brush.

10. The lotion application device of claim 9, wherein the two spinning brush heads comprise an outer layer that has an external surface with a texture providing means to hold lotion.

11. The lotion application device of claim 10, wherein the electrically powered brush is in communication with the motor, which is used to drive a drive shaft in spinning of the two spinning brush heads.

12. The lotion application device of claim 11, wherein the motor is in communication with a controller, for controlling the motor.

13. The lotion application device of claim 12, wherein at least one battery is connected to the controller, which provides a power source for the motor.

14. The lotion application device of claim 13, wherein the motor and rotation and speed of the two spinning brush heads is controlled by a remote control.

15. A lotion application device for applying creams or lotions on a user's feet, the lotion application device comprising:

a base component comprising a bottom surface, opposing right and left sidewalls and opposing front and back sidewalls, and an open cavity for insertion of the at least one foot;

wherein the opposing right and left sidewalls and the opposing front and back sidewalls extend up from the bottom surface to create the open cavity which retains at least one foot, as well as the two spinning brush heads and lotion;

wherein an interior of the base component comprises a dispenser component for retaining lotion;

wherein the base component comprises an electrically powered brush and two spinning brush heads for evenly distributing lotion to treat dry and cracked skin on the feet;

wherein the two spinning brush heads comprise an outer layer that has an external surface with a texture providing means to hold lotion;

wherein the electrically powered brush is in communication with a motor, which is used to drive a drive shaft in spinning of the two spinning brush heads;

wherein the motor is in communication with a controller, for controlling the motor;

wherein at least one battery is connected to the controller, which provides a power source for the motor;

wherein the motor and rotation and speed of the two spinning brush heads is controlled by a remote control; and wherein the motor is further configured to engage the dispenser component to dispense the lotion into the open cavity when activated by the remote control.

16. The lotion application device of claim 15, wherein an exterior of the base component comprises an actuator button for manually powering on and off the motor.

17. The lotion application device of claim 16, wherein the base component comprises an LCD screen, which is in communication with at least one battery and controller and alerts a user as to battery life and comprises the actuator button.

18. The lotion application device of claim 15, wherein the controller is configured to wirelessly communicate with a mobile application, such that the base component comprises a wireless control unit, which is connected to and controls the motor to rotate the two spinning brush heads and is wirelessly connected to a smartphone and the mobile application on the smartphone.

19. The lotion application device of claim 15 further comprising a plurality of indicia.

20. A method of applying lotion to a user's feet, the method comprising the following steps:

providing a lotion application device comprising a base component with an open cavity and an electrically powered brush;

inserting at least one foot into the open cavity;

dispensing lotion or ointment from a dispensing component within an interior of the base component via a remote activated motor as needed onto the foot within the open cavity; and operating the electrically powered brush via a remote control to rotate and evenly distribute lotion or ointment on the user's foot.

* * * * *